United States Patent [19]

Rynne

[11] 4,285,802

[45] Aug. 25, 1981

[54] ZINC-NICKEL ALLOY ELECTROPLATING BATH

[76] Inventor: George B. Rynne, 223 15th St., NE., Atlanta, Ga. 30309

[21] Appl. No.: 123,109

[22] Filed: Feb. 20, 1980

[51] Int. Cl.[3] ..... C25D 3/56

[52] U.S. Cl. ..... 204/43 Z

[58] Field of Search ..... 204/43 Z, 43 T

[56] References Cited

U.S. PATENT DOCUMENTS 2,419,231 4/1947 Schantz ..... 204/43 Z 4,104,133 8/1978 Brannan et al. ..... 204/43 Z

*Primary Examiner*—Howard S. Williams

*Attorney, Agent, or Firm*—Jones, Thomas & Askew

[57] ABSTRACT

An aqueous bath for producing a bright zinc-nickel alloy electroplated deposit. The bath includes a soluble zinc containing compound, a soluble nickel salt, an ammoniated electrolyte, a non-ammoniated electrolyte, a non-ionic polyoxyalkylated surfactant and an aromatic aldehyde. The bath can also be ammonia-free, wherein the bath also includes boric acid and an aromatic carbonyl compound.

10 Claims, No Drawings

ZINC-NICKEL ALLOY ELECTROPLATING BATH

TECHNICAL FIELD

The present invention relates to electroplating baths, and more particularly to such baths for producing a bright zinc-nickel alloy electroplated deposit.

BACKGROUND OF THE INVENTION

Electrodeposition of metals on ferrous and non-ferrous substrates is a well known method for providing corrosion protection and for providing improved cosmetic appearance. Heretofore, such electrodeposition has been carried out by essentially two types of electroplating baths.

One such electroplating bath is cyanide-based. However, the use of cyanide electrolytes present significant ecological problems and require expensive waste treatment equipment. Moreover, cyanide baths are toxic and tend to embrittle certain sheets and exhibit low current efficiencies.

In an effort to overcome the deficiencies of the cyanide baths, chloride-based zinc baths of essentially three types were developed. These three types of baths were termed neutral, ammonia based and non-ammonia based. Although these chloride-based baths eliminate the toxicity problem of the cyanide baths, these baths also have other limitations. The neutral and ammonia based baths contain excessive amounts of ammonium ions and/or chelates, thereby making metal removal costly and difficult. The non-ammonia based baths generally result in deposits which are brittle at thicknesses over 0.5 mils and which flake at thicknesses less than 0.5 mils. Furthermore, iron co-deposition, which causes a dull appearance and poor corrosion protection, is a problem with all chloride-based baths.

Examples of such chloride-based zinc baths are discussed in detail in U.S. Pat. Nos. 4,070,256; 3,694,330; Re. 27,999; 3,729,394; 3,730,855; 3,838,026 and 3,855,085 (all incorporated herein by reference). Although the foregoing patents disclose chloride-based zinc baths, they do not disclose a zinc-nickel alloy bath. Zinc-nickel alloy electroplating is advantageous over conventional zinc electroplating in that it provides superior corrosion resistance, minimization of iron codeposition and ductile deposits at thicknesses over 0.5 mils.

SUMMARY OF THE INVENTION

The present invention provides an aqueous bath for producing a bright zinc-nickel alloy electroplated deposit. The bath includes a soluble zinc containing compound, a soluble nickel salt, an ammoniated electrolyte, a non-ammoniated electrolyte, a non-ionic polyoxyalkylate surfactant and an aromatic aldehyde.

In another embodiment of the present invention, the bath is ammonia free. In the ammonia free bath, the ammoniated electrolyte is replaced by boric acid and an aromatic carbonyl compound.

Accordingly, it is an object of the present invention to provide an improved zinc-nickel alloy electroplating bath.

Another object of the present invention is to provide an electroplating bath which provides a bright zinc-nickel electrodeposit.

A further object of the present invention is to provide a zinc-nickel electroplating bath which is ammonia-containing or which is ammonia-free.

Yet another object of the present invention is to provide a zinc-nickel electroplating bath which produces a zinc-nickel electro deposit which does not flake at thin deposition thicknesses and which possesses excellent ductility at relatively thick deposition thicknesses.

Another object of the present invention is to provide a zinc-nickel electroplating bath which reduces or substantially eliminates iron co-deposition.

These and other objects, features and advantages of the present invention will become apparent from a review of the following detailed description of the disclosed embodiment and the appended claims.

DETAILED DESCRIPTION OF THE DISCLOSED EMBODIMENTS

The zinc-nickel electroplating bath of the present invention can be ammonia-containing or ammonia-free. The ammonia-containing bath will be considered first.

The ammonia-containing bath of the present invention includes, in aqueous solution, a soluble zinc containing compound, a soluble nickel salt, an ammoniated electrolyte, a non-ammoniated electrolyte, a non-ionic polyoxyalkylated surfactant and an aromatic aldehyde.

The soluble zinc containing compounds useful in the bath of the present invention are zinc chloride, zinc oxide and mixtures thereof. The soluble zinc containing compound is present in the solution in an amount which provides between approximately 10 and 100 grams of zinc as metal per liter of solution; preferably between 50 and 80 grams per liter of solution. Generally, it is found that at concentrations of zinc metal ions in the solution of less than approximately 10 grams per liter, poor deposition efficiency results. At concentrations of zinc metal ions in the solution greater than approximately 100 grams per liter, the zinc containing compound has poor solubility in the solution and deposition is uneconomical.

The soluble nickel salt useful in the bath of the present invention is nickel chloride. The soluble nickel salt is present in the solution in an amount which provides between approximately 0.01 and 10 grams of nickel as metal per liter of solution; preferably between 3 and 5 grams per liter of solution. Generally, it is found that at concentrations of nickel metal ions in the solution of less than approximately 0.01 grams per liter, virtually no codeposition of the nickel results; whereas there is excessive iron codeposition. At concentrations of nickel metal ions in the solution greater than approximately 10 grams per liter, excessive codeposition of nickel results, thereby causing poor post-plate treatment and reduced corrosion resistance.

The ammoniated electrolyte useful in the present invention is ammonium chloride which is the soluble ammonium salt of hydrochloric acid. The ammonium chloride is present in an amount which provides between approximately 1 and 10 grams of ammonium ions per liter of solution; preferably 5 grams per liter. Generally, it is found that at concentrations of ammonium ions in the solution of less than approximately 1 gram per liter, the addition of boric acid is required as if the bath were ammonia-free, as will be discussed in more detail hereinbelow. At concentrations of ammonium ions greater than approximately 10 grams per liter, the ammonium ion causes difficulty in the removal of heavy metals from effuents with conventional waste treatment systems.

The non-ammoniated electrolytes useful in the present invention are potassium chloride, sodium chloride and mixtures thereof. It should be noted that calcium chloride is not useful as a non-ammoniated electrolyte in the present invention. The non-ammoniated electrolyte is present in the solution in an amount which provides between approximately 25 and 300 grams of chloride ions per liter of solution, preferably between approximately 200 and 250 grams of chloride ions per liter of solution. Generally, it is found that at concentrations of chloride ions from the non-ammoniated electrolyte less than approximately 25 grams per liter, electrical conductivity is poor. At concentrations of chloride ions from the non-ammoniated electrolyte greater than approximately 300 grams per liter, solubility of the non-ammoniated electrolyte in the bath is difficult and the bath is uneconomical.

The non-ionic polyoxyalkylated surfactants useful in the present invention are non-ionic block copolymers: of ethylene oxide and linear alcohols, of ethylene oxide and phenol alcohols, of ethylene oxide and coconut fatty acids and mixtures thereof. The condensation products of these materials contain between approximately 15 and 50 moles of ethylene oxide per mole of alcohol or fatty acid.

Non-ionic block copolymers of ethylene oxide and linear alcohols useful in the present invention have the following structural formula:

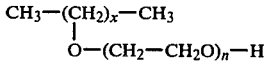

$$CH_3-(CH_2)_x-CH_3$$
$$\quad\;\; |$$
$$\quad\;\; O-(CH_2-CH_2O)_n-H$$

wherein x is an integer from 9 to 15 and n is an integer from 10 to 50. Surfactants of the foregoing structure are members of the Tergitol S Series available from Union Carbide. Examples of those useful surfactants are Tergitol Nonionic 15-S-3, Tergitol Nonionic 15-S-5, Tergitol Nonionic 15-S-7, Tergitol Nonionic 15-S-9 and Tergitol Nonionic 15-S-12.

Non-ionic block copolymers of ethylene oxide and phenol alcohols useful in the present invention have the following structural formula.

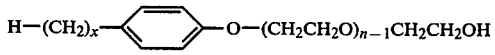

$$H-(CH_2)_x-C_6H_4-O-(CH_2CH_2O)_{n-1}CH_2CH_2OH$$

wherein x is an integer from 6 to 15 and n is an integer from 10 to 50. Surfactants of the foregoing structure are members of the Igepol CO surfactants available from GAF Corporation (Igepol is the registered trademark of GAF Corporation).

Coconut fatty acids generally have the following structural formula:

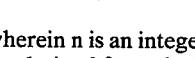

$$C_nH_{2n+1}COOH$$

wherein n is an integer from 5 to 17. Coconut fatty acids are derived from the hydrolysis of coconut oil. Coconut fatty acids are well known in the art for their use as surfactants.

Non-ionic block copolymers of ethylene oxide and monoethanol amine coconut fatty acid, condensates useful in the present invention are prepared by condensing 5 moles of ethylene oxide with each mole of the monoethanol amide-coconut fatty acid. The resulting condensation product has a molecular weight of approximately 475 and an ethylene oxide content of approximately 46% weight percent thereof.

Other specific examples of non-ionic polyoxyalkylated surfactants useful in the present invention include, for example, alkoxylated alkyl phenols, e.g., nonylphenol; alkyl naphthols; aliphatic monohydric alcohols; aliphatic polyhydric alcohols, e.g., polyoxypropylene glycol; ethylene diamine; fatty acids, fatty amids, e.g., amide of coconut fatty acid; or esters, e.g., sorbitan monopalmitate. Exemplary alkoxylated compounds within the above classes which are commercially available include "Igepal" CA 630, trade name for an ethoxylated octyl phenol, available from the GAF Corp.; "Brij" 98, trade name for an ethoxylated oleyl alcohol available from ICI America, Inc.; "Pluronic" F68, trade name for a polyoxyethylenepolyoxypropylene glycol available from BASF Wyandotte Corp.; "Surfynol" 485, trade name for ethoxylated 2,4,7,9-tetramethyl-5-decyne-4,7-diol available from Air Products and Chemicals, Inc.; "Tetronic" 504, trade name for an ethoxylated propoxylated ethylene diamine available from BASF Wyandotte Corp.; "Myrj" 525, trade name for an ethoxylated stearic acid available from ICI America, Inc.; "Amidoa" C-5, trade name for a polyethoxylated coconut acid monoethanolamide available from Stepan Chemical Co.; and "Tween" 40, trade name for an ethoxylated sorbitan palmitate available from ICI American, Inc.

The nonionic polyoxyalkylated surfactants are present in the solution in an amount between approximately 5 and 50 grams per liter of solution; preferably between 10 and 15 grams per liter. Generally, it is found that at concentrations of surfactant less than approximately 5 grams per liter, a poor plating range and coarse deposits result. At concentrations of surfactant greater than approximately 50 grams per liter, solubility of the surfactant is poor and the bath is uneconomical.

All aromatic aldehydes are useful as brighteners in the present invention and specifically include all aryl aldehydes, all ring-halogenated aryl aldehydes and heterocyclic aldehydes. Preferred aromatic aldehydes include ortho-chlorobenzaldehyde, para-chlorobenzaldehyde and thioplene aldehyde. It has been found that aromatic ketones do not generally work satisfactorily in the present invention as undesirable bands usually result when plating with baths containing aromatic ketones.

The aromatic aldehydes are present in the bath in an amount between approximately 0.05 and 4 grams per liter of solution; preferably between approximately 0.5 and 1.5 grams per liter of solution. Generally, it is found that at concentration of aromatic aldehyde less than approximately 0.05 grams per liter, no significant brightening effect results; whereas, at concentrations above approximately 4 grams per liter, brittle deposits and non-uniform plating results.

The pH of the zinc-nickel ammonia-containing electroplating bath useful in the present invention is between approximately 3.0 and 6.9. Boric acid, which acts as a buffer and also helps keep the zinc metal ions in solution, can optionally be added to the ammonia-containing bath to adjust the pH to the desired range.

The ammonia-free bath of the present invention is identical to the foregoing-described ammonia-containing bath, except the ammoniated electrolyte is eliminated and substituted therefor are boric acid and an aromatic carbonyl compound.

Boric acid, which acts as a buffer and a high current density grain refiner, must be added to the ammonia-free bath in order to keep the zinc ions in solution. The boric acid is present in the bath in an amount between approximately 10 and 40 grams per liter of solution; preferably between approximately 25 and 30 grams per liter. Generally, it is found that concentrations of boric acid below approximately 10 grams per liter does not provide sufficient buffering and causes zinc metal to be in a non-platable ionic state; whereas, at concentrations above approximately 40 grams per liter, boric acid has poor solubility in the solution.

The aromatic carbonyl compounds useful in the present invention include benzoic acid, nicotinic acid, and cinnamic acid. The major contribution of the carbonyl compound in the bath of the present invention is to provide platable ion concentration control. The aromatic carbonyl compound is present in the ammonia-free bath of the present invention in an amount between approximately 1.5 and 15 grams per liter of solution.

The pH of the zinc-nickel ammonia-free electroplating bath useful in the present invention is between approximately 3.0 and 6.9. Potassium hydroxide can be added to electroplating baths of the present invention if the pH of the bath is too low. Similarly, ammonium hydroxide can be added to the ammonia-containing baths to raise the pH to the desired level. Hydrochloric acid can be added to the electroplating baths of the present invention if the pH of the bath is too high. It is generally desirable in the present invention to keep the ions in the electroplating bath as compatible as possible. Therefore, sodium hydroxide and sulfuric acid are not recommended for use in the present invention.

During electrodeposition of the baths of the present invention, the temperature of the baths is preferably maintained between approximately 10° and 30° C. As the temperature of the bath is increased, there is a tendency for the minimum current density for satisfactory plating to increase, and a simultaneous increase in the maximum current density at which satisfactory plating can be obtained.

The following examples are provided to illustrate, but not to limit, the present invention. All temperatures are given in degrees Celsius and all amounts are grams per liter of aqueous solution unless specifically stated otherwise.

EXAMPLE 1

An aqueous bath is prepared containing 70 grams per liter of zinc chloride, 5 grams per liter of nickel chloride, 10 grams per liter of ammonium chloride, 200 grams per liter of potassium chloride, 12 grams per liter of ethoxylated nonyl phenol alcohol and 1 gram per liter of ortho-chlorobenzaldehyde. The pH of the bath is about 4.5.

A series of Hull cell panels is plated at 3.0 amps. for a period of three minutes without agitation while the bath is maintained at a temperature of about 20° C. The resulting panels are found to have lustrous deposits of zinc-nickel alloy through a plating range of 1–40 a.s.f. At currents over 40 a.s.f., the deposit is dull gray and burning. Bend tests at deposit thicknesses of 0.5 mils are excellent. The deposit contained an average alloy nickel content of 2% to 3%.

The pH of the bath is adjusted to about 3.0 by the addition of hydrochloric acid and a further series of panels is run at the same conditions. Again bright, lustrous deposits are produced over a range of 1–40 a.s.f.

EXAMPLE 2

An aqueous bath is prepared containing 60 grams per liter of zinc chloride, 3 grams per liter of nickel chloride, 250 grams per liter of potassium chloride, 20 grams per liter of boric acid, 3 grams per liter of cinnamic acid, 15 grams per liter of ethoxylated isononyl alcohol and 0.05 grams per liter of para-chlorobenzaldehyde. The pH of the bath is about 4.0.

The bath is employed in a commercial plating tank for rack plating of steel alloy parts having various dimensions and geometric configurations. The bath is maintained at a temperature of about 25° C. The plating range varies between 1 and 60 a.s.f. and lustrous deposits are produced over the entire range. The deposits are found to be ductile and adherent. The alloy average nickel content is about 1% to 2%.

EXAMPLE 3

A bath is prepared containing the following compounds on a per liter basis:

zinc chloride: 50 grams
nickel chloride: 2 grams
potassium chloride: 180 grams
ammonium chloride: 5 grams
ethoxylated tributyl phenol: 10 grams
benzoic acid: 4 grams
ortho-chlorobenzaldehyde: 1 gram The pH of the bath is 4.5.

Plating is carried out as in Example 2. Lustrous deposits are produced over a plating range of 1–30 a.s.f. Bend tests at 0.5 mils are excellent. Alloy average nickel content is 1% to 2%.

EXAMPLE 4

A bath is prepared containing the following compounds on a per liter basis:

zinc chloride: 80 grams
nickel chloride: 8 grams
potassium chloride: 250 grams
boric acid: 20 grams
benzoic acid: 4 grams
ethoxylated nonylphenol alcohol: 35 grams
thiophene aldehyde: 1 gram The pH of the bath is 4.5.

Plating is carried out as in Example 2. Lustrous deposits are produced over a plating range of 1–60 a.s.f. Bend tests at thicknesses of 0.5 mils are excellent. Alloy average nickel content is 3%–4%.

EXAMPLE 5

A bath is prepared containing the following compounds on a per liter basis:

zinc chloride: 30 grams
nickel chloride: 1 gram
sodium chloride: 200 grams
ammonium chloride: 5 grams
ethoxylated coconut fatty acid: 20 grams
nicotinic acid: 2 grams
ortho-chlorobenzaldehyde: 1 gram The pH of the bath is 4.0

Plating is carried out as in Example 2. Lustrous deposits are produced over a plating range of 1–30 a.s.f. Average alloy nickel content is 1%–2%.

Generally, it is found that the superior corrosion resistance of the zinc-nickel alloy electroplated deposits of the present invention are provided by electrodeposit compositions of between approximately 95% and 99.9% by weight zinc and between approximately 0.1% and 5% by weight nickel as an alloy.

It should be understood, of course, that the foregoing relates only to a preferred embodiment of the present invention and that numerous modifications or alterations may be made therein without departing from the spirit and scope of the invention as set forth in the appended claims.

I claim:

1. An aqueous bath for producing a bright zinc-nickel alloy electroplated deposit having superior corrosion resistance, said bath comprising, on a per liter basis:

(a) a soluble zinc containing compound providing 10–100 grams of zinc as metal and selected from the group consisting of zinc chloride and zinc oxide;

(b) a soluble nickel salt providing 0.01–10 grams of nickel as a metal, said soluble nickel salt being nickel chloride;

(c) an ammoniated electrolyte providing 1–10 grams of ammonium ions, said ammoniated electrolyte being ammonium chloride;

(d) a non-ammoniated electrolyte selected from the group consisting of potassium chloride and sodium chloride, said non-ammoniated electrolytes providing 25–300 grams of chloride ions;

(e) 5–50 grams of a non-ionic polyoxy alkylated surfactant selected from the group consisting of:

nonionic block copolymers of ethylene oxide and linear alcohols having the following structural formula;

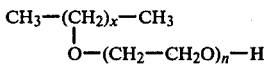

wherein x is an integer from 9 to 15 and n is an integer from 10 to 50;

nonionic block copolymers of ethylene oxide and phenol alcohols having the following structural formula;

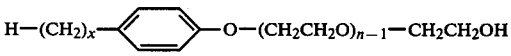

wherein x is an integer from 6 to 15 and n is an integer from 10 to 50;

nonionic block copolymers of ethylene oxide and monoethanol amine coconut fatty acid condensate having a total molecular weight of about 475 and an ethylene oxide content of about 46 weight percent thereof;

alkoxylated alkyl phenols, alkoxylated alkyl naphthols, alkoxylated aliphatic monohydric alcohols, alkoxylated polyoxpropylene glycols, alkoxylated 2,4,7,9-tetramethyl-5-decyne-4,7-diol, alkoxylated ethylene diamine, alkoxylated fatty acids, alkoxylated amides, alkoxylated esters; and (f) 0.05–4 grams of an aromatic aldehyde, said bath having a pH of 3.0–6.9.

2. The bath of claim 1, wherein said ammoniated electrolyte provides 1–10 grams of ammonium ions.

3. An aqueous bath for producing a bright zinc-nickel alloy electroplated deposit having superior corrosion resistance, said bath comprising, on a per liter basis:

(a) a soluble zinc containing compound providing 1–100 grams of zinc as metal and selected from the group consisting of zinc chloride and zinc oxide;

(b) a soluble nickel salt providing 0.01–10 grams of nickel as a metal, said soluble nickel salt being nickel chloride;

(c) a non-ammoniated electrolyte selected from the group consisting of potassium chloride and sodium chloride, said non-ammoniated electrolyte providing 25–300 grams of chloride ions;

(d) 5–50 grams of a non-ionic polyoxyalkylated surfactant selected from the group consisting of:

nonionic block copolymers of ethylene oxide and linear alcohols having the following structural formula:

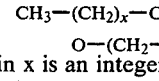

wherein x is an integer from 9 to 15 and n is an integer from 10 to 50;

nonionic block copolymers of ethylene oxide and phenol alcohols having the following structural formula:

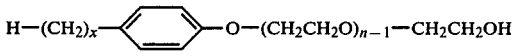

wherein x is an integer from 6 to 15 and n is an integer from 10 to 50;

nonionic block copolymers of ethylene oxide and monoethanol amine coconut fatty acid condensate having a total molecular weight of about 475 and an ethylene oxide content of about 46 weight percent thereof; and alkoxylated alkyl phenols, alkoxylated alkyl naphthols, alkoxylated aliphatic monohydric alcohols, alkoxylated polyoxypropylene glycols, alkoxylated 2,4,7,9-tetramethyl-5-decyne-4,7-diol, alkoxylated ethylene diamine, alkoxylated fatty acids, alkoxylated amides, alkoxylated esters; and (e) 0.05–4 grams of an aromatic aldehyde;

(f) 10–40 grams of boric acid; and (g) 1.5 to 15 grams of an aromatic carbonyl compound selected from the group consisting of benzoic acid, nicotinic acid and cinnamic acid, said bath having a pH of 3.0–6.9.

4. The bath of claims 1 or 3, wherein said soluble zinc containing compound provides 50–80 grams of zinc as a metal.

5. The bath of claims 1 or 3, wherein said soluble nickel salt provides 3–5 grams of nickel as a metal.

6. The bath of claim 3, wherein said non-ammoniated electrolyte provides 200–250 grams of chloride ions.

7. The bath of claims 1 or 3, wherein said nonionic polyoyalkylate surfactant is present in an amount between 10 and 15 grams.

8. The bath of claims 1 or 3, wherein said aromatic aldehyde is present in an amount between 0.5 and 1.5 grams.

9. The bath of claim 3, wherein said boric acid is present in an amount between 3 and 4 grams.

10. A substrate having an electrodeposit the bath of claim 1 or 2 thereon, said electrodeposit comprising a nickel-zinc alloy electrodeposit having superior corrosion resistance, said electrodeposit comprising approximately 95% to 99.9% by weight zinc and approximately 0.1% to 5% by weight nickel as an alloy.

* * * * *